US008640575B2

(12) United States Patent
Huang

(10) Patent No.: US 8,640,575 B2
(45) Date of Patent: Feb. 4, 2014

(54) BALL END HEX WRENCH

(75) Inventor: Ping-Wen Huang, Taichung (TW)

(73) Assignee: New Way Tools Co., Ltd, Taichung (TW)

( * ) Notice: Subject to any disclaimer, the term of this patent is extended or adjusted under 35 U.S.C. 154(b) by 259 days.

(21) Appl. No.: 13/216,334

(22) Filed: Aug. 24, 2011

(65) Prior Publication Data

US 2013/0047798 A1 Feb. 28, 2013

(51) Int. Cl.
*B25B 23/00* (2006.01)
*B25B 15/00* (2006.01)

(52) U.S. Cl.
USPC ..... 81/461; 81/436

(58) Field of Classification Search
USPC ..... 81/436, 441, 461
See application file for complete search history.

(56) References Cited

U.S. PATENT DOCUMENTS

| | | | | | |
|---|---|---|---|---|---|
| 1,055,031 | A * | 3/1913 | Groos | 81/436 |
| 1,738,405 | A * | 12/1929 | Thal | 81/436 |
| 1,741,349 | A * | 12/1929 | Sullivan | 81/441 |
| 1,899,489 | A * | 2/1933 | Wickbergh | 81/441 |
| 5,251,521 | A * | 10/1993 | Burda et al. | 81/460 |
| 5,259,279 | A * | 11/1993 | Strauch | 81/436 |
| 5,259,280 | A * | 11/1993 | Hoy | 81/436 |
| 5,284,075 | A * | 2/1994 | Strauch et al. | 81/436 |
| 5,370,021 | A * | 12/1994 | Shigematsu | 81/436 |
| 5,873,290 | A * | 2/1999 | Chaconas | 81/436 |
| 6,152,000 | A * | 11/2000 | Mowins | 81/441 |
| 6,681,662 | B2 * | 1/2004 | Blackston | 81/451 |
| 6,684,741 | B2 * | 2/2004 | Blackston | 81/451 |
| 7,044,034 | B2 * | 5/2006 | Hsien | 81/452 |
| 2001/0020405 | A1 * | 9/2001 | Bozonnet | 81/436 |
| 2004/0031360 | A1 * | 2/2004 | Her | 81/436 |
| 2005/0076749 | A1 * | 4/2005 | Liu | 81/436 |
| 2007/0051215 | A1 * | 3/2007 | Petillo | 81/436 |
| 2010/0167240 | A1 * | 7/2010 | Benzon et al. | 433/174 |
| 2011/0098715 | A1 * | 4/2011 | Laubert et al. | 606/104 |
| 2011/0271800 | A1 * | 11/2011 | Lin | 81/436 |

FOREIGN PATENT DOCUMENTS

| | | |
|---|---|---|
| TW | M284495 | 1/2006 |

* cited by examiner

*Primary Examiner* — David B Thomas
(74) *Attorney, Agent, or Firm* — Alan Kamrath; Kamrath IP Lawfirm, P.A.

(57) ABSTRACT

A ball end hex wrench includes a ball end including an engaging section, at least one first pattern, and at least one second pattern. The engaging section includes a plurality of peripheral surfaces disposed circumferentially. The at least one first pattern is defined on one of the plurality of peripheral surfaces. The at least one first pattern has a first longitudinal length and a first height. The at least one second pattern is defined on the one of the plurality of peripheral surfaces. The at least one second pattern has a second longitudinal length and a second height. The second height is different from the first height.

9 Claims, 15 Drawing Sheets

BALL END HEX WRENCH

BACKGROUND OF THE INVENTION

1. Field of the Invention

The present invention relates to a ball end hex wrench.

2. Description of the Related Art

TW Patent No. M284495 shows a ball end hex wrench. The hex wrench includes a ball end adapted for driving an object. Generally, the object has a hole defined therein for receiving the ball end. In this hex wrench, the ball end includes a recess defined therein. Further, a detent ball and a spring are disposed in the recess. The detent ball is moveable in the recess and positionable at a position that includes a portion disposed outside an opening of the recess. Moreover, the detent ball has a spherical shape and is resiliently biased by the spring to abut against a periphery of the hole of the object. According to the patent, the resiliently biased detent ball allows the ball end to be engaged and disengaged from the hole of the object more easily, the hole of the object to be less likely to become damaged, and operating the hex wrench to drive the object more effortlessly. However, a problem that the detent ball and the spring suffer is that they are liable to be damaged when a relative large resistance force is overcome in order to drive the object. Another problem is that installation of the detent ball and the spring are laborious. Additionally, it becomes easier for the hex wrench to turn relative to the object, so the object is not driven as the hex wrench is operably moved in this regard.

The present invention is, therefore, intended to obviate or at least alleviate the problems encountered in the prior art.

SUMMARY OF THE INVENTION

According to the present invention, a ball end hex wrench includes a ball end capable of being used to drive an object. The ball end includes an engaging section, at least one first pattern, and at least one second pattern. The engaging section is abutted against the object when the ball end hex wrench drives the object. The engaging section includes a plurality of peripheral surfaces. The plurality of peripheral surfaces are disposed circumferentially. Each of the plurality of peripheral surfaces extends arcuately. The at least one first pattern is defined on one of the plurality of peripheral surfaces. The at least one first pattern has a first longitudinal length and a first height. The at least one second pattern is defined on the one of the plurality of peripheral surfaces. The at least one second pattern has a second longitudinal length and a second height. The second height is different from the first height. The hex wrench further includes an operating end, and a neck. The neck includes a first distal end connected with the ball end and a second distal end connected with the operating end respectively and extends arcuately from the first distal end to the second distal end.

It is an object of the present invention to allow the ball end to be engaged and disengaged from the object more easily.

It is another object of the present invention to prevent the ball end hex wrench from easily damaging a hole of the object.

It is a further object of the present invention to render operating the hex wrench to drive the object more effortlessly.

Other objects, advantages, and new features of the present invention will become apparent from the following detailed description of the invention when considered in conjunction with the accompanied drawings.

DETAILED DESCRIPTION OF THE PREFERRED EMBODIMENTS

Figure 1:
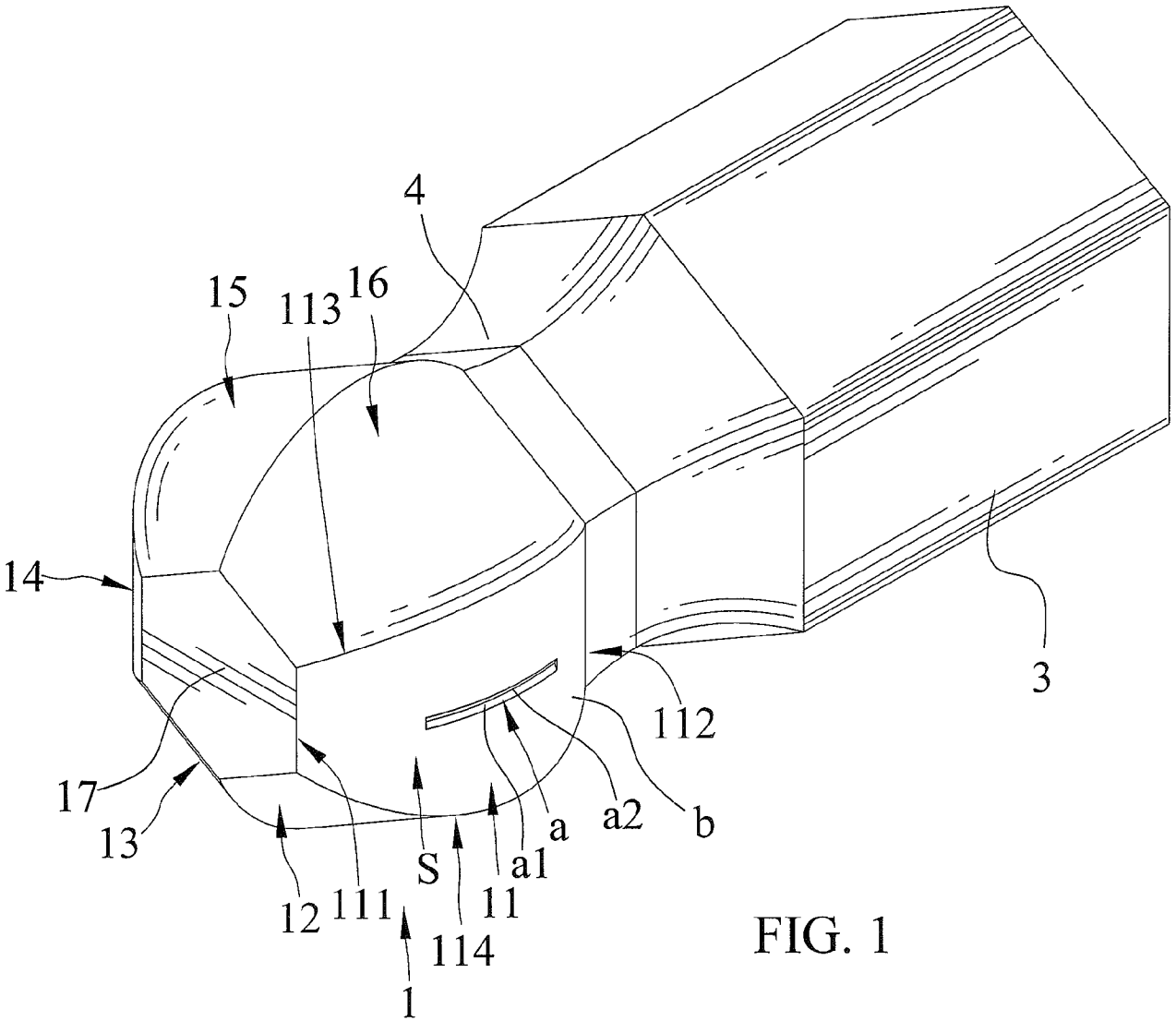
FIG. 1 is a perspective view of a ball end hex wrench in accordance with a first embodiment of the present invention.

FIGS. 1 through 4 show a ball end hex wrench in accordance with a first embodiment of the present invention. The ball end hex wrench includes a ball end 1. The ball end 1 includes first and second ends 111 and 112, and first and second lateral sides 113 and 114 extending from the first end 111 to the second end 112. Moreover, the ball end 1 includes an engaging section S, at least one first pattern a, and at least one second pattern b. The engaging section S includes a plurality of peripheral surfaces, i.e., first, second, third, fourth, fifth, and sixth peripheral surfaces 11, 12, 13, 14, 15, and 16. The plurality of peripheral surfaces 11, 12, 13, 14, 15, and 16 are disposed circumferentially. Each of the plurality of peripheral surfaces 11, 12, 13, 14, 15, and 16 extends arcuately. The at least one first pattern a is defined on one of the plurality of peripheral surfaces 11, 12, 13, 14, 15, and 16, i.e., the first peripheral surface 11. Also, the at least one first pattern a is extended therein on the one of the plurality of peripheral surfaces 11, 12, 13, 14, 15, and 16. The at least one first pattern a has a first height. The at least one first pattern a is extended in the first peripheral surface 11. The first pattern a defines a recess. The first pattern a includes two slopes a1. The two slopes a1 are disposed oppositely and extend toward each other. The two slopes a1 include a common edge defining a bottom edge a2 of the first pattern a. The at least one second pattern b is defined on the one of the plurality of peripheral surfaces 11, 12, 13, 14, 15, and 16. The at least one second pattern b has a second height. The second height is different from the first height. The second pattern b is flush with the first peripheral surface 11. Moreover, the ball end 1 includes the second end 112 including an end surface 17. The end surface 17 includes a peripheral edge which delimits first distal ends of the plurality of peripheral surfaces 11, 12, 13, 14, 15, and 16. In the embodiment, the end surface 17 is a planar surface.

The ball end hex wrench further includes an operating end 3, and a neck 4. The neck 4 includes a first distal end connected with the ball end 1 and a second distal end connected with the operating end 3 respectively and extends arcuately from the first distal end to the second distal end.

The ball end hex wrench is capable of driving an object 2 and defines a range of working angles. The object 2 includes a hole 201, an end wall 202, and a lateral wall 203. The hole 201 includes one of two opposite distal ends defining an opening and the other distal end delimited by the end wall 202. Moreover, the hole 201 includes a periphery delimited by the lateral wall 203. Therefore, when the object 2 is being driven by the ball end hex wrench, the ball end hex wrench includes the ball end 1 disposed in the hole 201, the end surface 17 abutted against the end wall 202, and the engaging section S including a region circumferentially abutted against the lateral wall 203, as well as the first pattern a partially contacting with the lateral wall 203. Additionally, the ball end hex wrench entirely includes the first longitudinal length of the first pattern a capable of contacting with the lateral wall 203.

Figure 2:
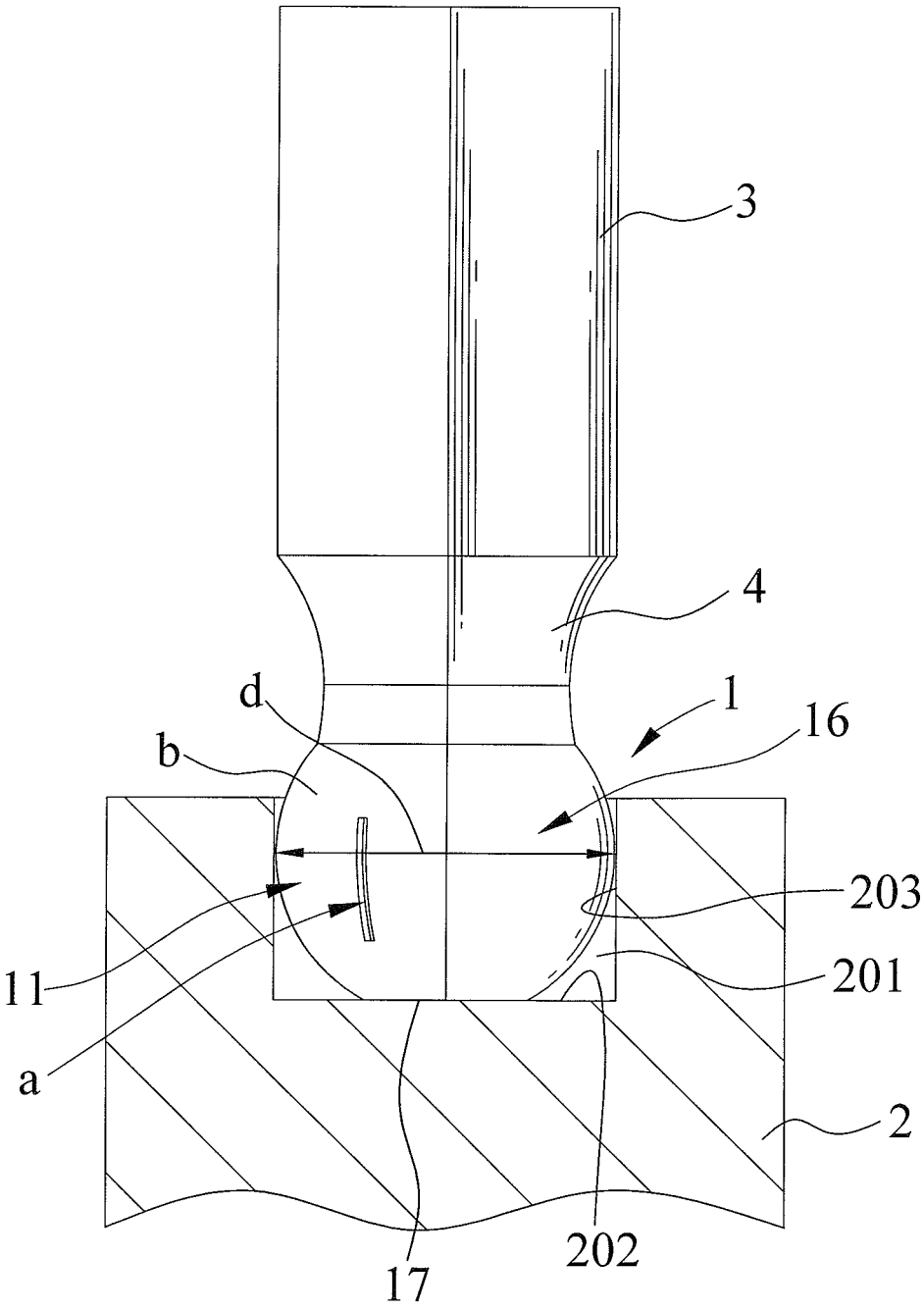
FIG. 2 shows the hex wrench of FIG. 1 driving a first object and disposed at a first working-angle position, with the ball end engaged with the first object, with the ball end received in a hole defined in the first object.
Figure 4:
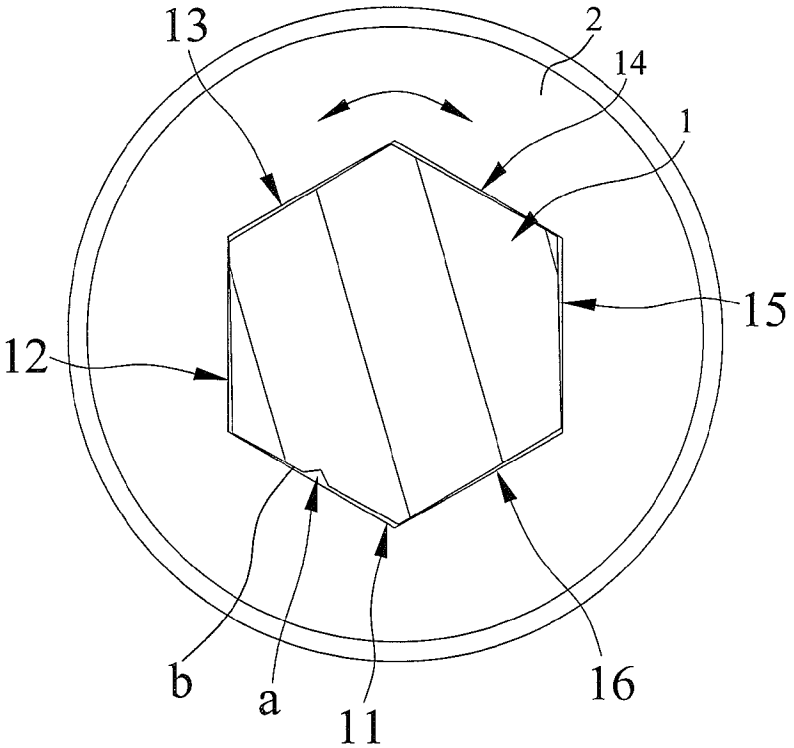
FIG. 4 is an extended cross-sectional view of FIG. 3 showing the hex wrench in the operation of driving the first object, with the ball end abutted against a periphery of the hole of the first object.
Figure 3:
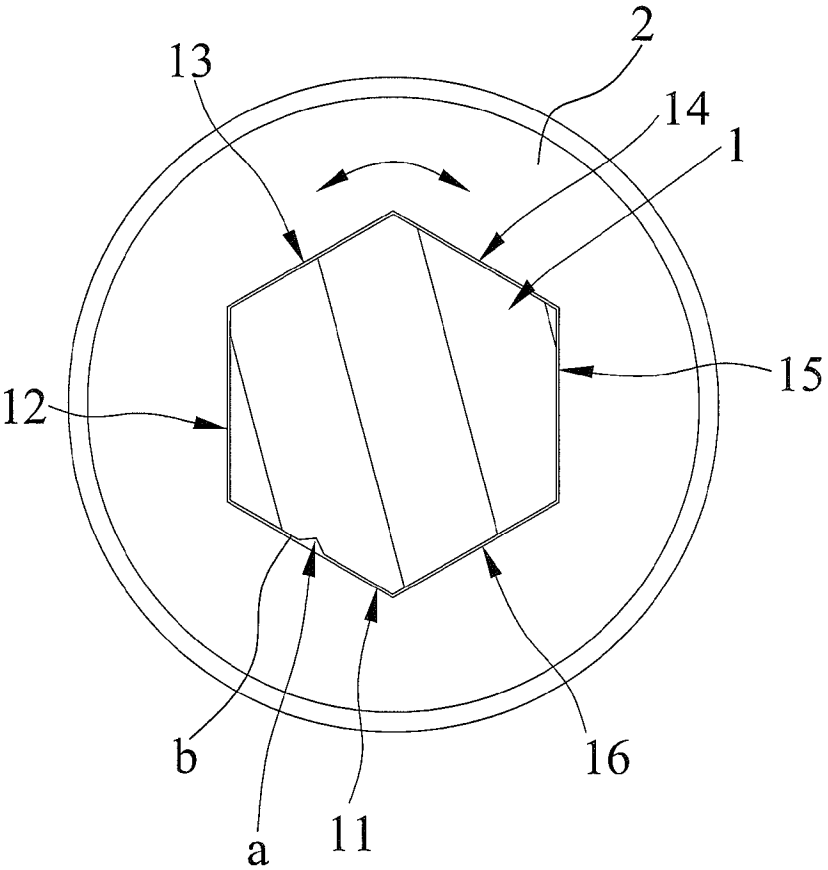
FIG. 3 is a cross-sectional view of FIG. 2.
Figure 5:
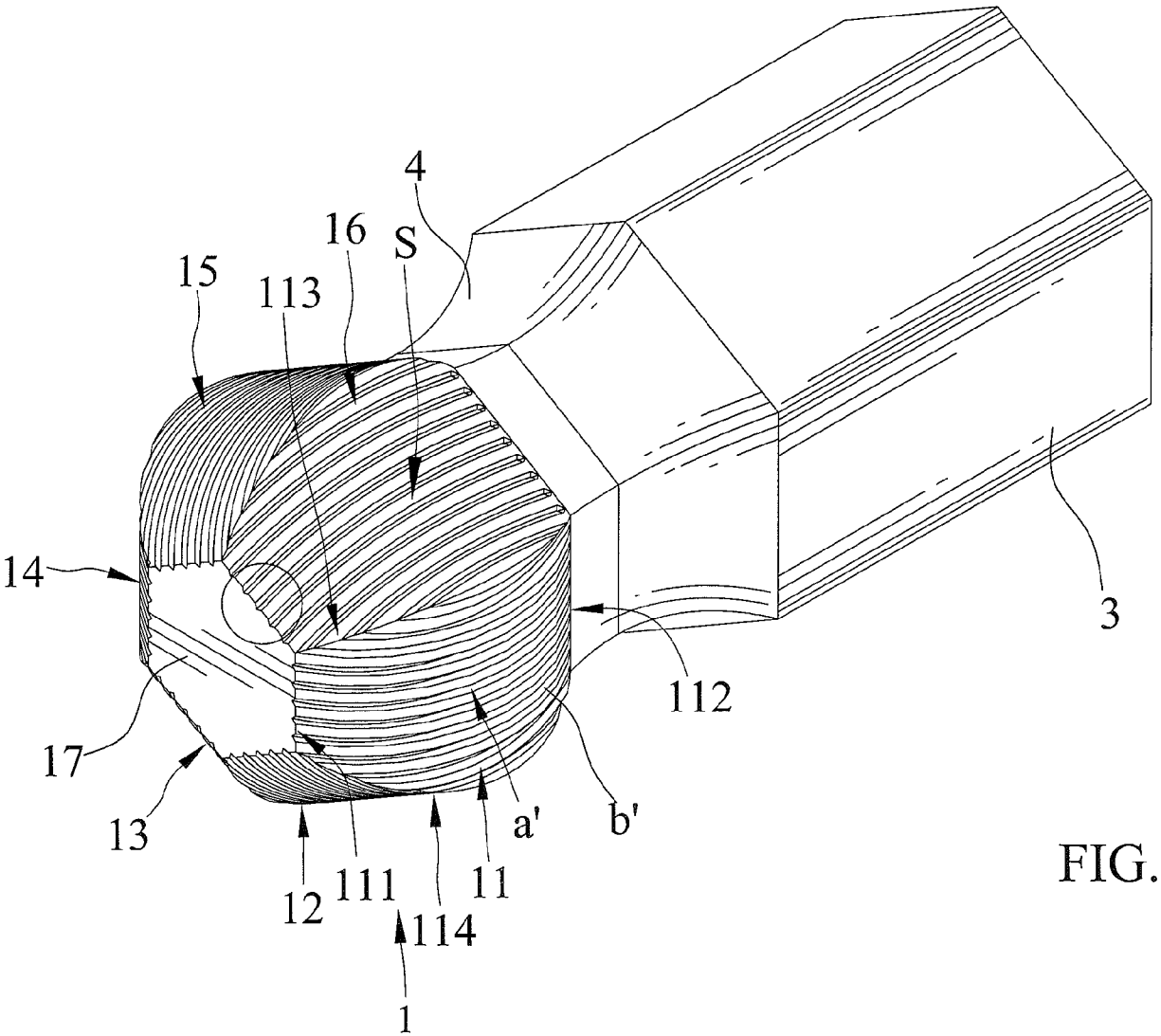
FIG. 5 is a perspective view of a ball end hex wrench in accordance with a second embodiment of the present invention.
Figure 6:
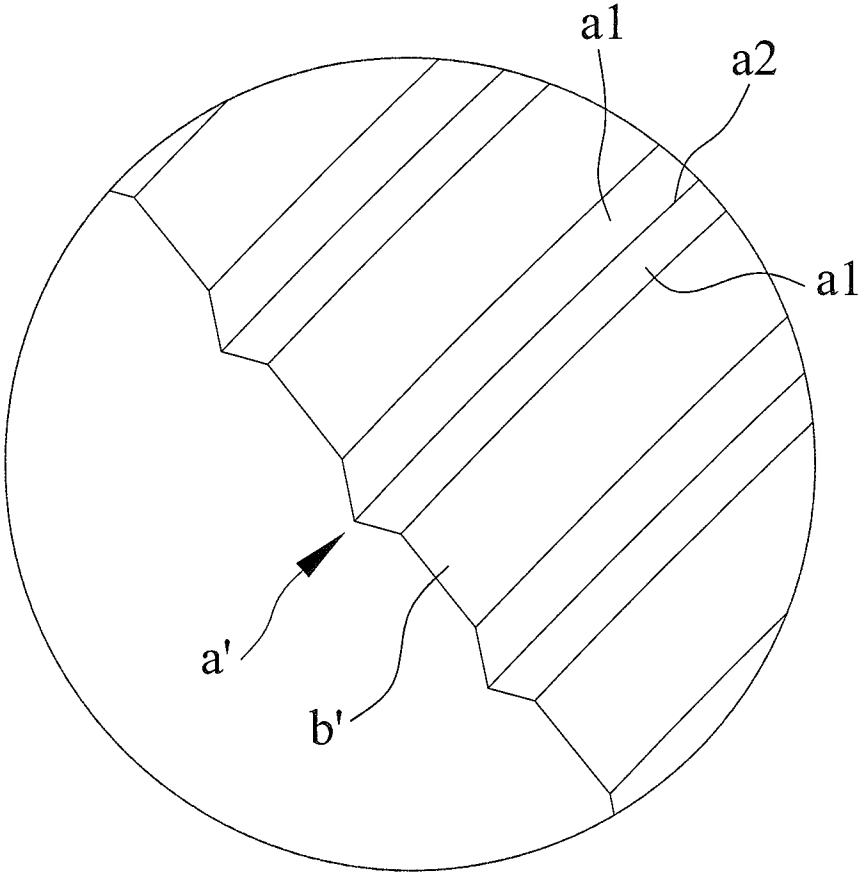
FIG. 6 is a partial enlarged view of FIG. 5.
Figure 7:
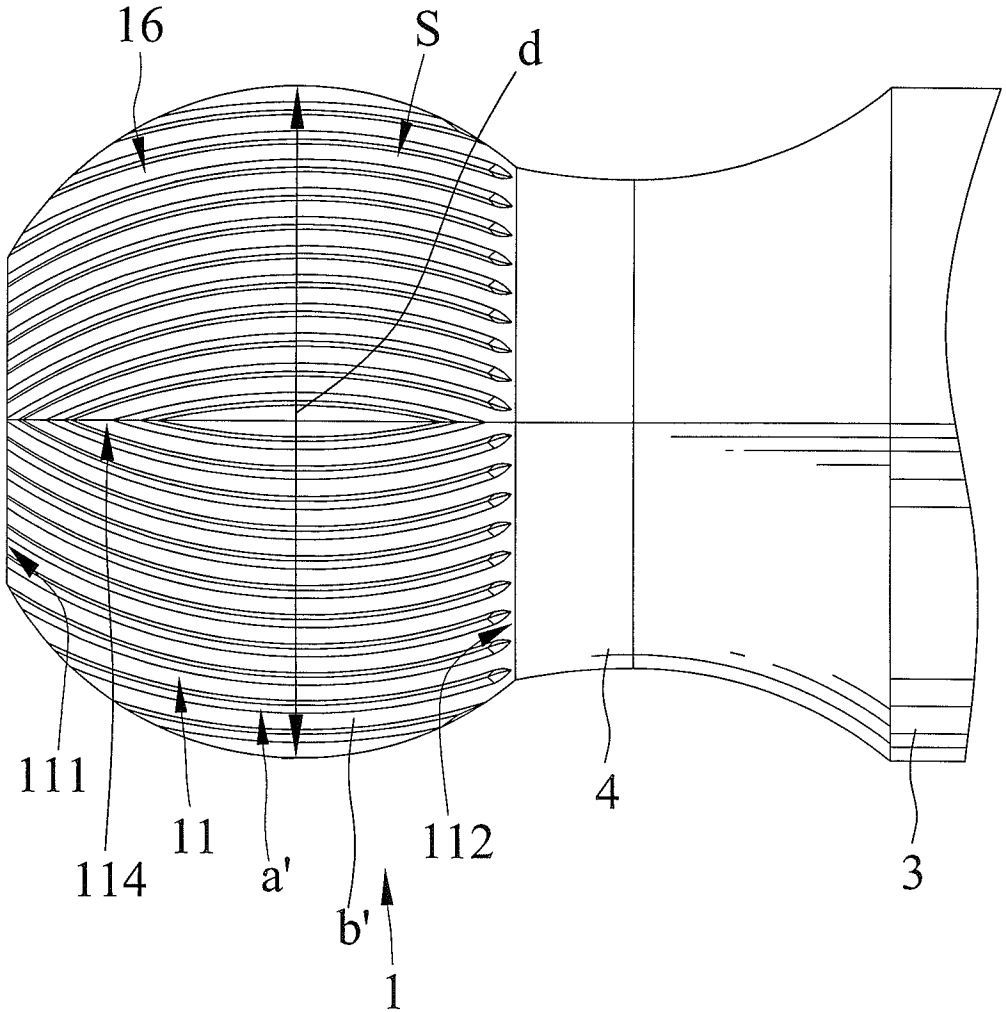
FIG. 7 is a partial, side view of the hex wrench of FIG. 5.
Figure 8:
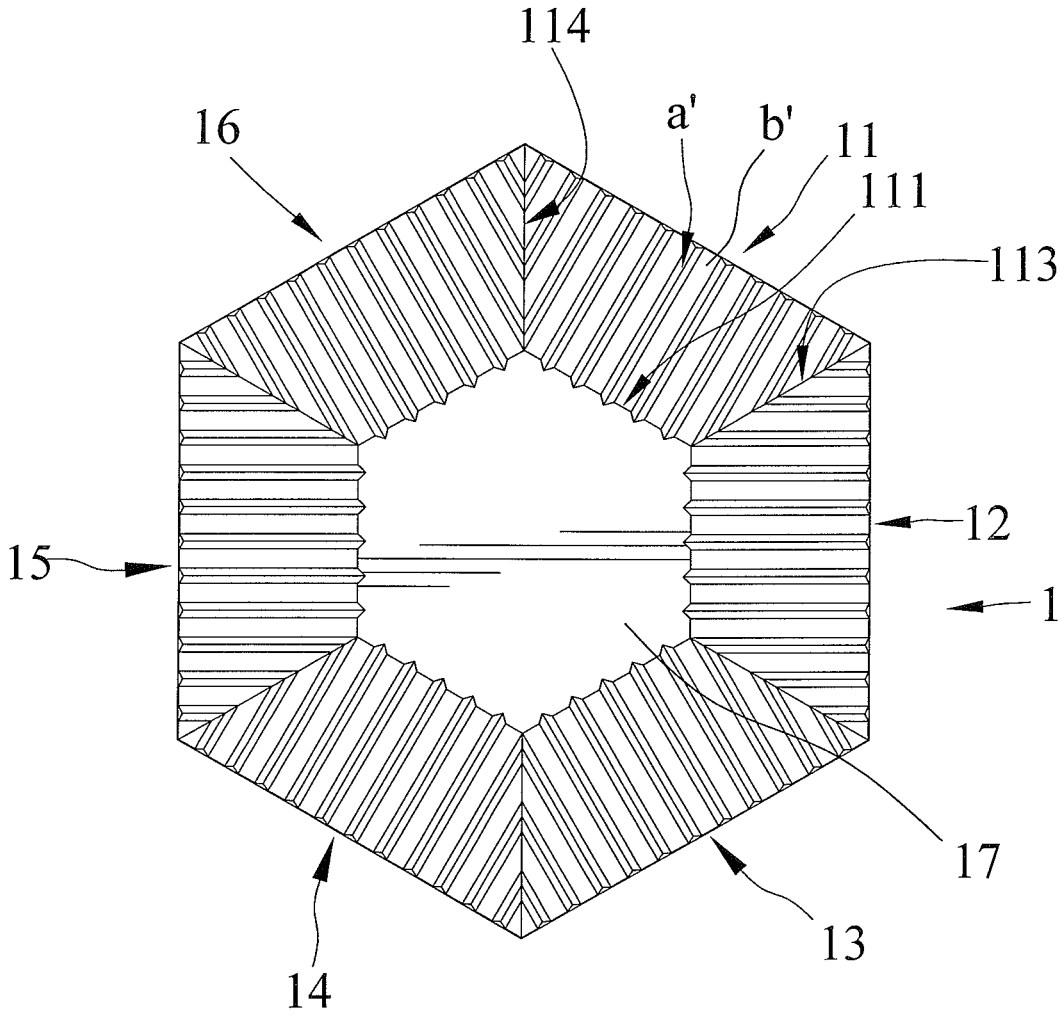
FIG. 8 is a top view of the hex wrench of FIG. 5.
Figure 9:
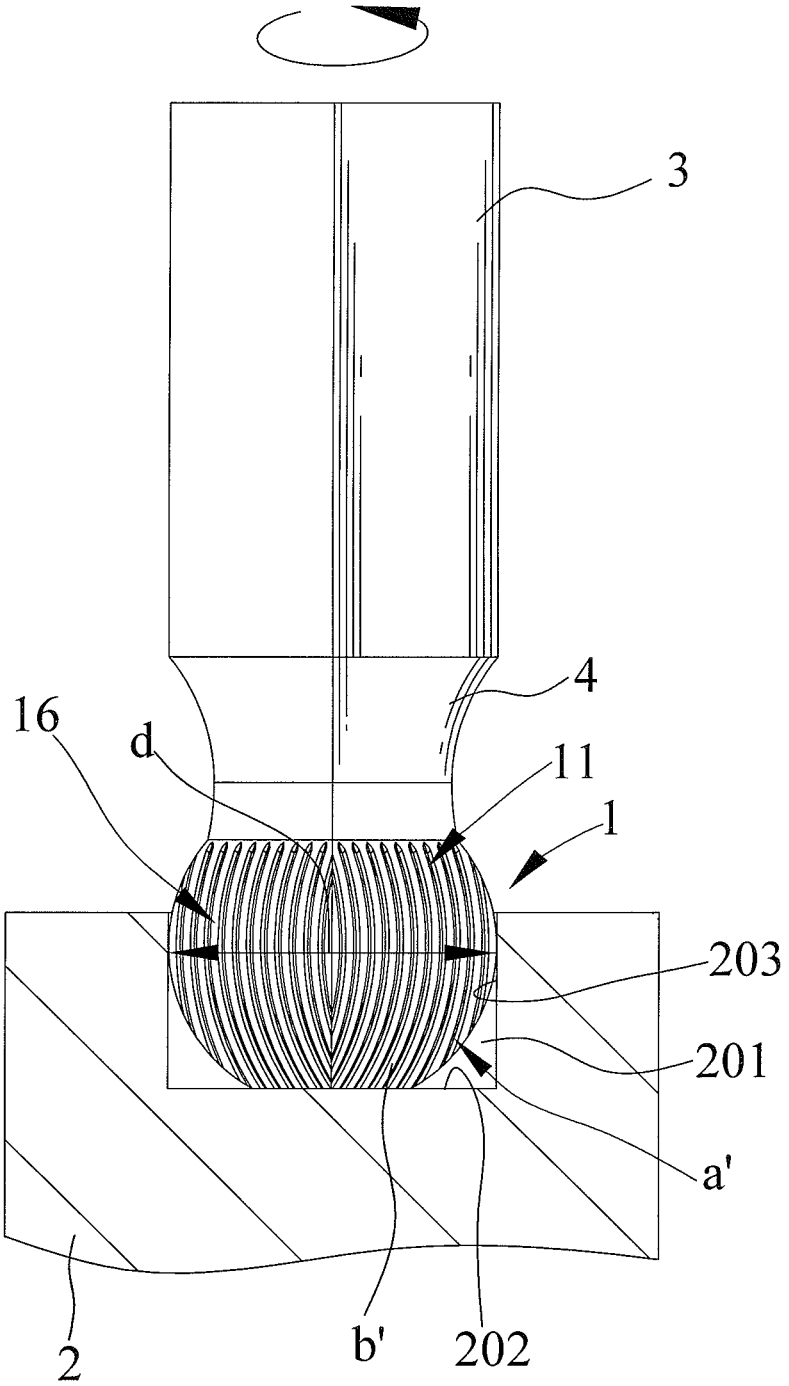
FIG. 9 shows the hex wrench of FIG. 5 driving the first object and disposed at the first working-angle position, with the ball end engaged with the first object, with the ball end received in the hole of the first object.
Figure 11:
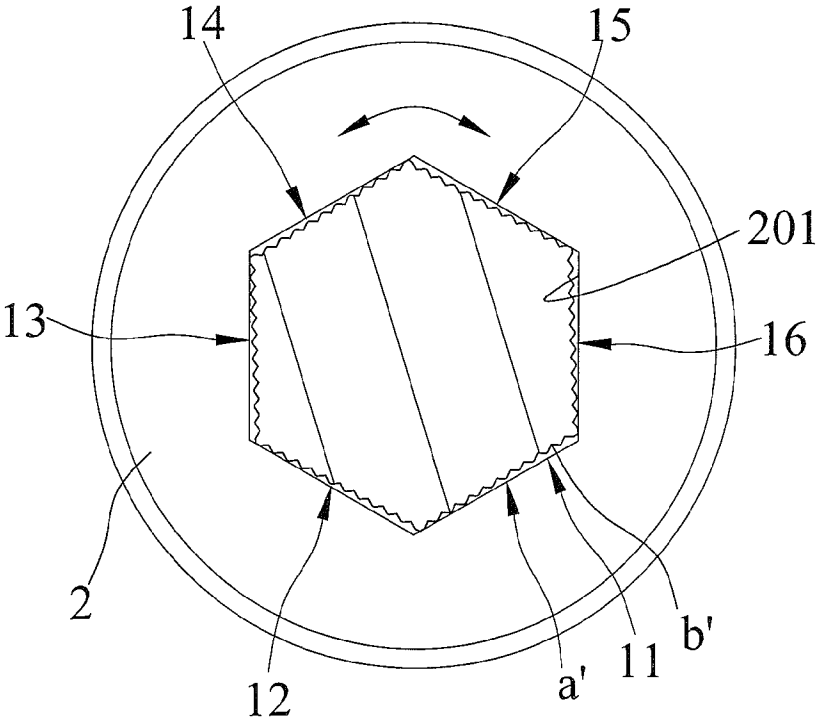
FIG. 11 is an extended cross-sectional view of FIG. 10 showing the hex wrench in the operation of driving the first object, with the ball end abutted against the periphery of the hole of the first object.
Figure 10:
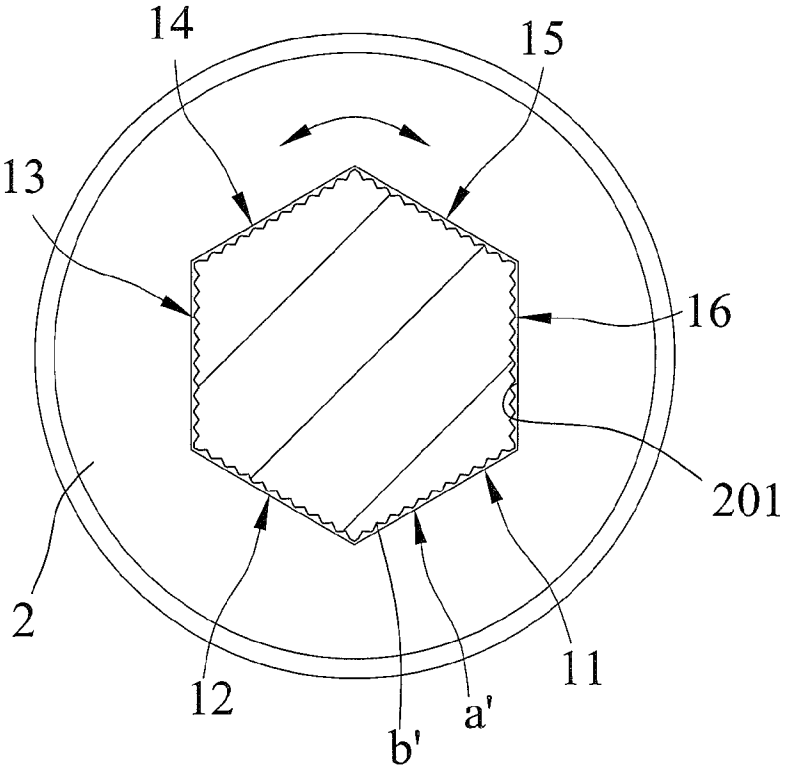
FIG. 10 is a cross-sectional view of FIG. 5.

FIG. 2 shows the ball end hex wrench in a position where it is disposed at one of the range of working angles, includes the ball end 1 disposed horizontally, and includes the engaging section S including a region with an outer diameter d, which is the maximum outer diameter of the ball end hex wrench, abutted against the lateral wall 203.

FIGS. 5 through 15 show a ball end hex wrench in accordance with a second embodiment of the present invention. The second embodiment differentiates from the first embodiment in that it includes a plurality of first and second patterns a' and b'. The plurality of first and second patterns a' and b' are defined on the first, second, third, fourth, fifth, and sixth peripheral surfaces 11, 12, 13, 14, 15, and 16. Each of the first, second, third, fourth, fifth, and sixth peripheral surfaces 11, 12, 13, 14, 15, and 16 includes the plurality of first patterns a' extended outward therefrom and the plurality of second pattern b' being flush therewith. Each of the plurality of first patterns a' defines a ridge. The plurality of first and second patterns a' and b' extend in the same direction. Two of the plurality of first patterns a' and b' include one of the plurality of second patterns b' disposed therebetween.

Figure 12:
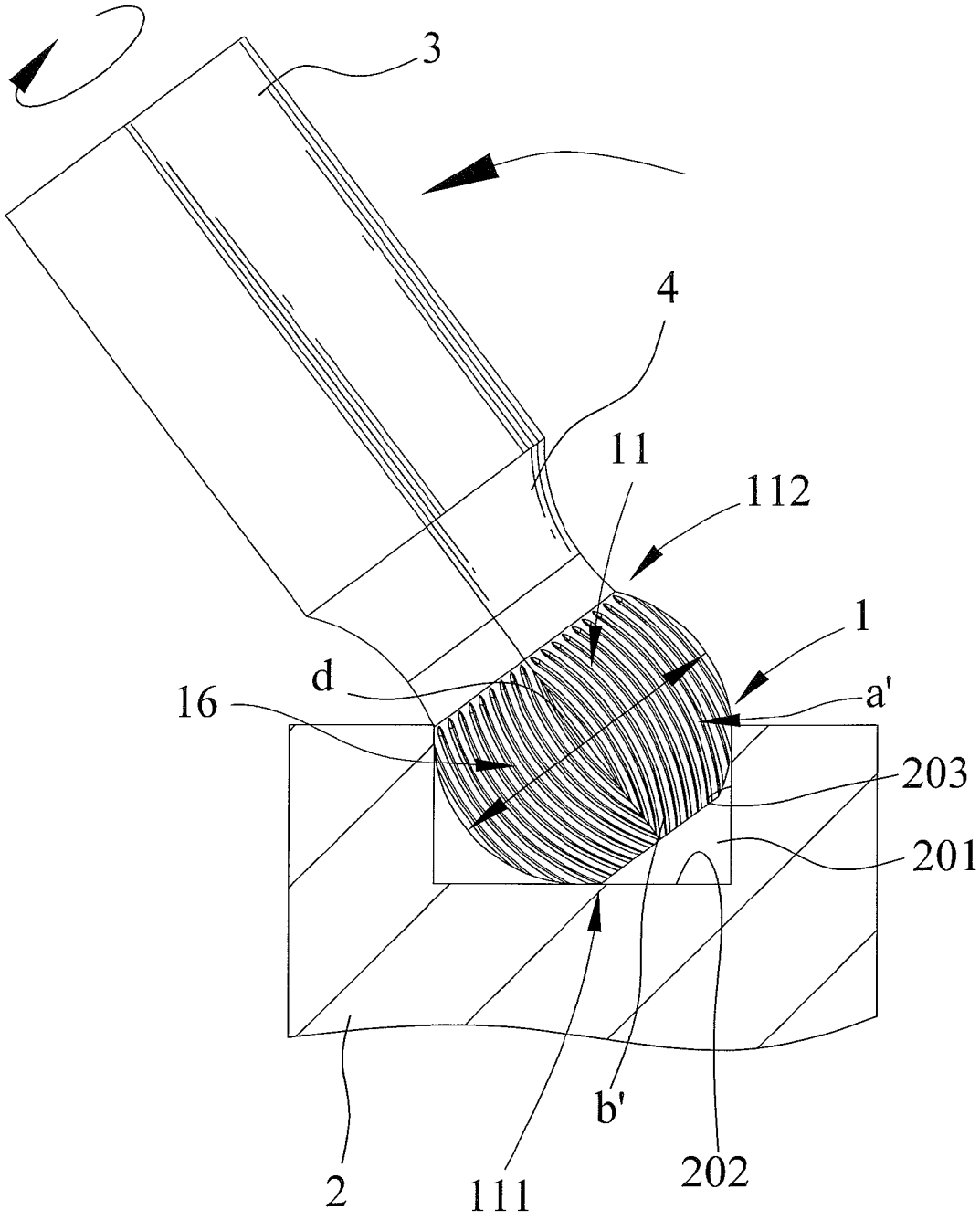
FIG. 12 shows the hex wrench of FIG. 5 in the operation of driving the first object and disposed at a second working-angle position.
Figure 13:
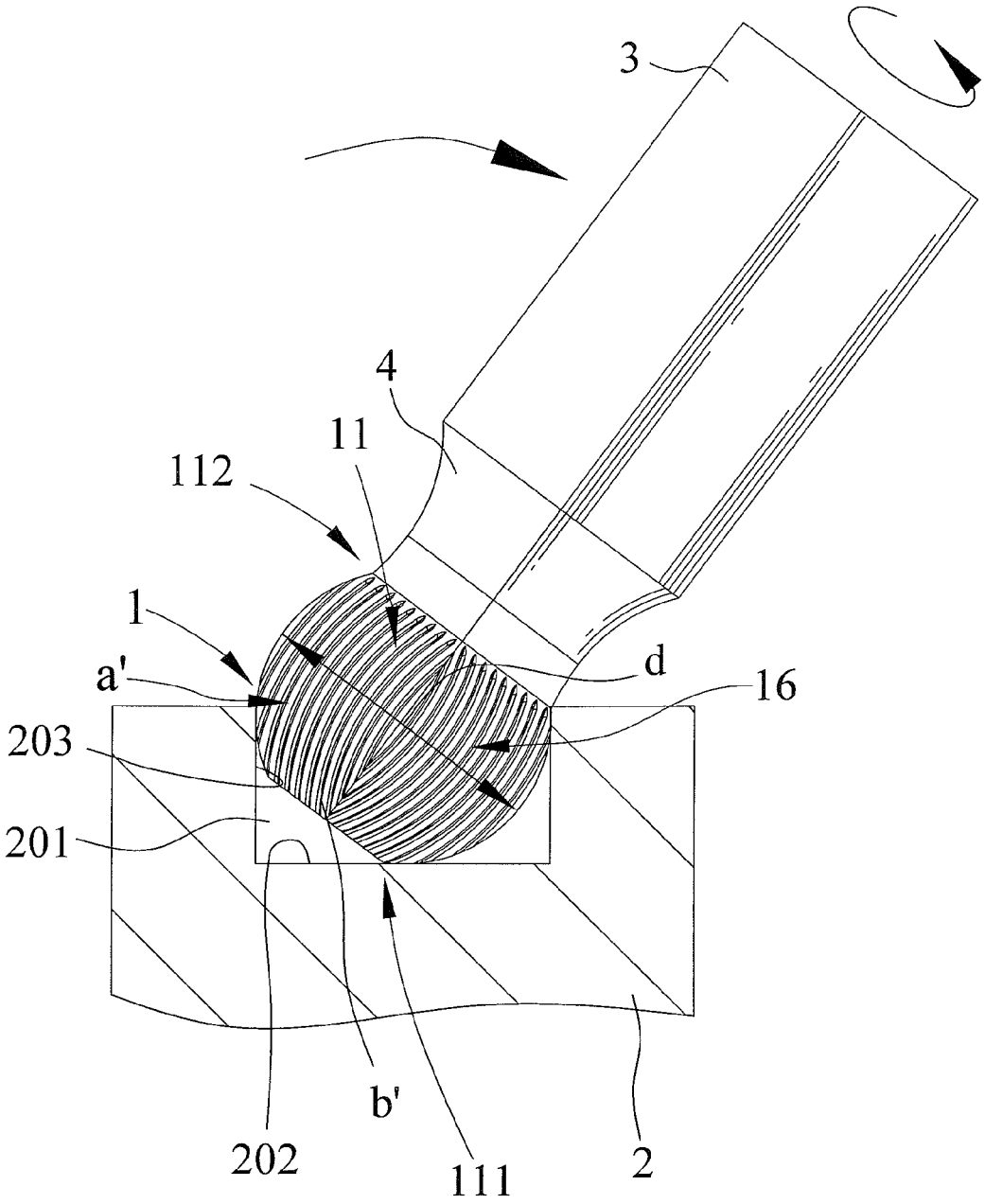
FIG. 13 shows the hex wrench of FIG. 5 in the operation of the driving the first object and disposed at a third working-angle position.
Figure 14:
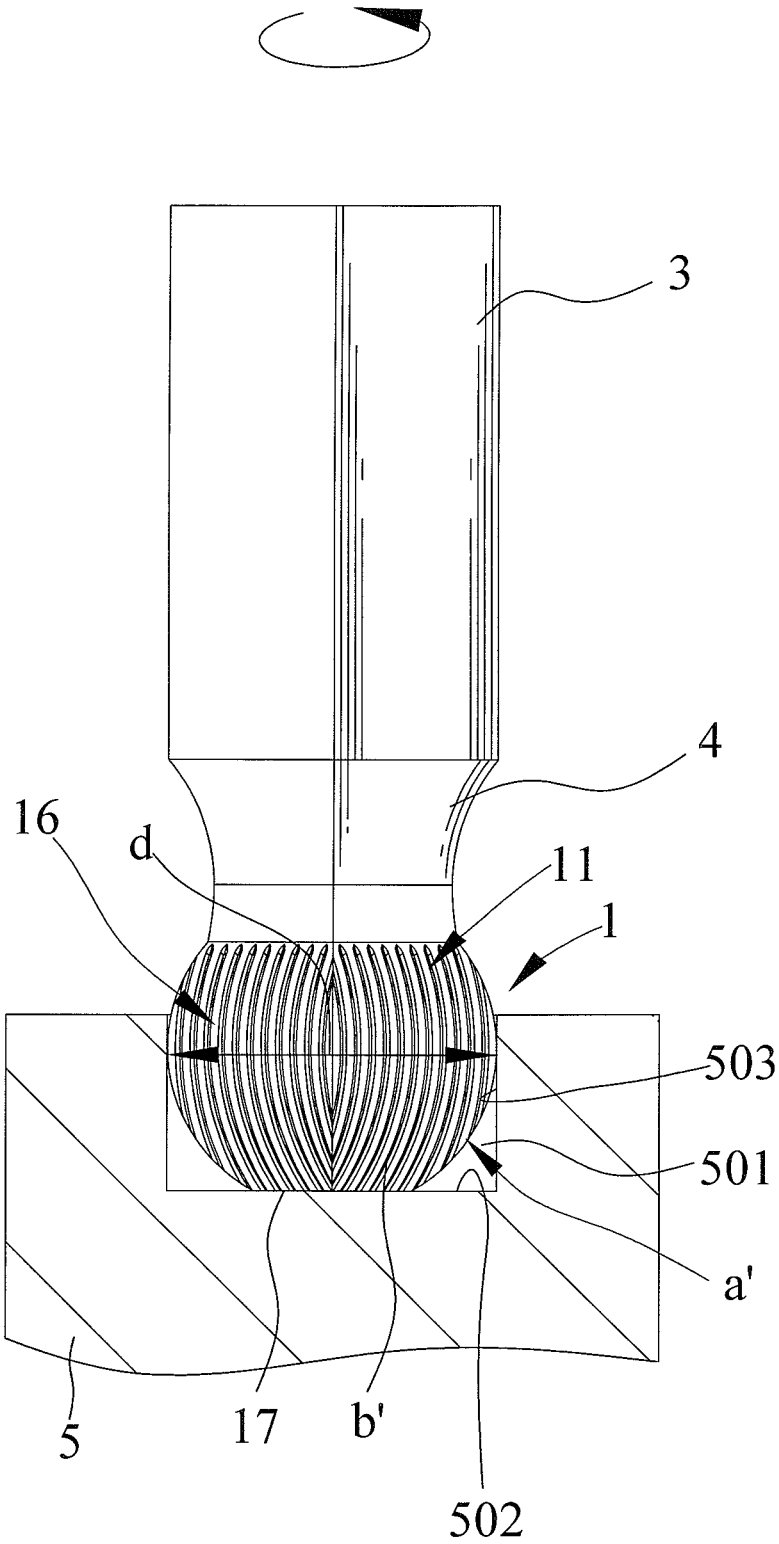
FIG. 14 shows the hex wrench of FIG. 5 in the operation of the driving a second object and disposed at the first working-angle position.
Figure 15:
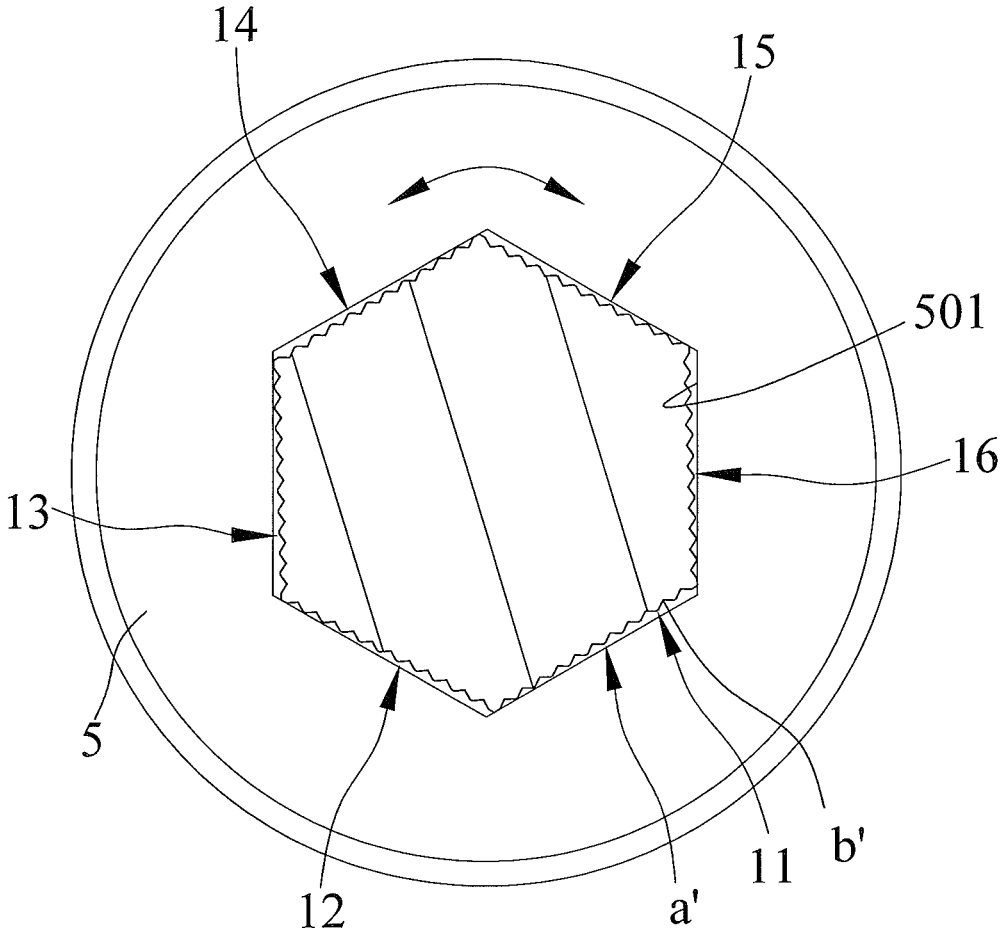
FIG. 15 is a cross-sectional view of FIG. 14 showing the hex wrench in the operation of driving the second object, with the ball end received in a hole defined in the second object, with the ball end abutted against a periphery of the hole of the second object.

The ball end hex wrench includes a first distal end and a second distal end, which is distanced from the first distal end at a longitudinal length. Additionally, FIG. 12 shows the hex wrench not disposed horizontally and including the first pattern a' including the first distal end abutted against the lateral wall 203 and the second distal end not abutted against the lateral wall 203. Furthermore, FIG. 13 shows the hex wrench not disposed horizontally and including the first pattern a' including the first distal end not abutted against the lateral wall 203 and the second distal end abutted against the lateral wall 203.

In addition, the ball end hex wrench is capable of being utilized to drive an object 5 which has a hole 501 that does not have a shape of a right hexagon. Likewise, the object 5 includes the hole 501 including one of two opposite distal ends defining an opening and the other distal end delimited by the end wall 502. Moreover, the hole 501 includes a periphery delimited by the lateral wall 503.

Figure 16:
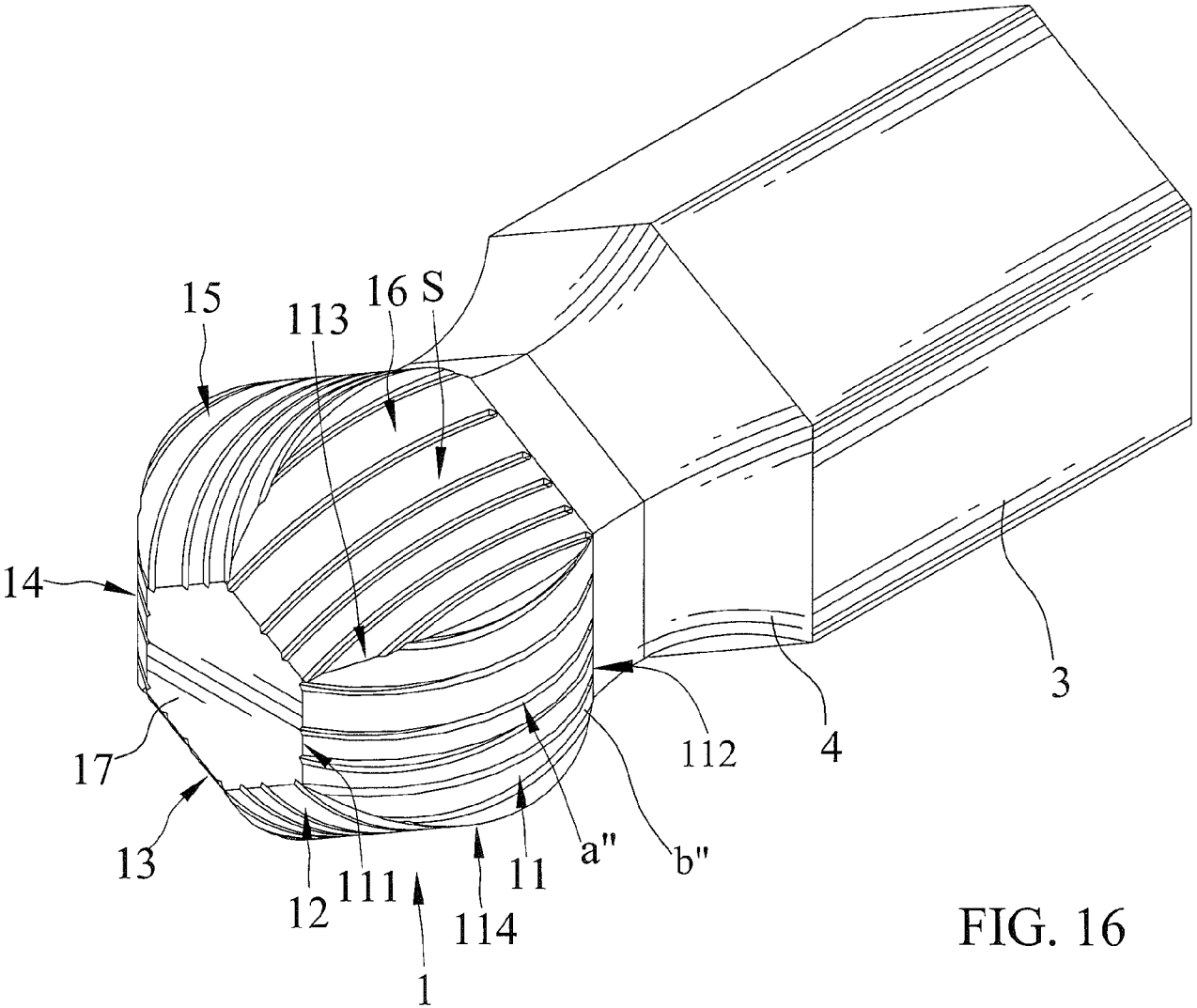
FIG. 16 is a perspective view of a ball end hex wrench in accordance with a third embodiment of the present invention.
Figure 18:
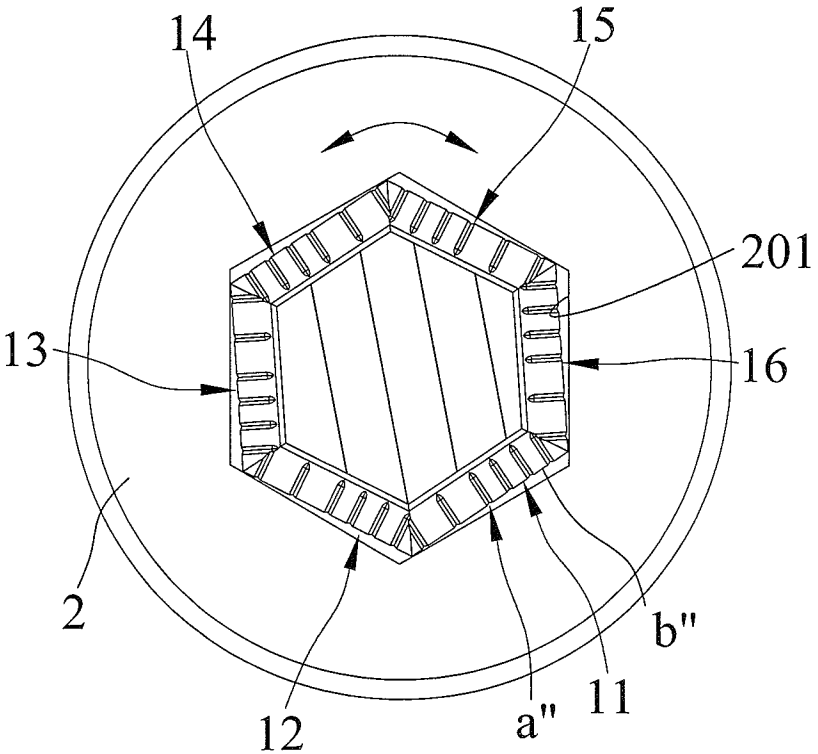
FIG. 18 is an extended cross-sectional view of FIG. 17 showing the hex wrench in the operation of driving the first object, with the ball end abutted against the periphery of the hole of the first object.
Figure 17:
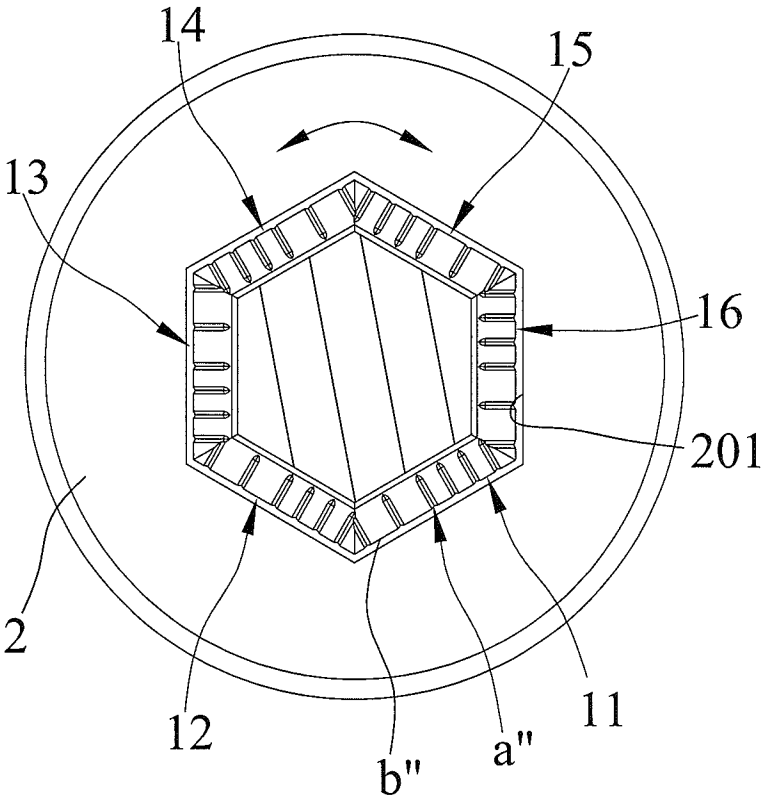
FIG. 17 is a cross-sectional view of FIG. 16.

FIGS. 16 through 18 show a ball end hex wrench in accordance with a third embodiment of the present invention. The third embodiment is similar to the second embodiment as it also includes a plurality of first and second patterns a" and b", but the number of the plurality of first and second patterns a" and b" are less than the number of the plurality of first and second patterns a' and b'. The plurality of first and second patterns a" and b" are defined on the first, second, third, fourth, fifth, and sixth peripheral surfaces 11, 12, 13, 14, 15, and 16. Each of the first, second, third, fourth, fifth, and sixth peripheral surfaces 11, 12, 13, 14, 15, and 16 includes the plurality of first patterns a" extended outward therefrom and the plurality of second pattern b" being flush therewith. Each of the plurality of first patterns a" defining defines a ridge. The plurality of first and second patterns a" and b" extend in the same direction. Two of the plurality of first patterns a" and b" include one of the plurality of second patterns b" disposed therebetween.

In view of the forgoing, the ball end hex wrench includes the first and second patterns a, a', and a"; b, b', and b" for allowing the ball end to be engaged and disengaged from the objects 2 and 5 more easily and for preventing the ball end from easily damaging the holes 201 and 501 of the objects 2 and 5. Thus, operating of the hex wrench to drive the object can become more effortless.

While the specific embodiments have been illustrated and described, numerous modifications come to mind without significantly departing from the spirit of invention, and the scope of invention is only limited by the scope of the accompanying claims.

What is claimed is:

1. A ball end hex wrench comprising:

a body having an operating end, a ball end, and a longitudinal axis extending between the operating end and the ball end, with the ball end capable of being used to drive an object when the body is rotated about the longitudinal axis, with the ball end including:

an engaging section abutting against the object when the ball end hex wrench drives the object, with the engaging section including a plurality of peripheral surfaces, with the plurality of peripheral surfaces disposed circumferentially around the longitudinal axis, with each of the plurality of peripheral surfaces extending in an arcuate shape in a direction parallel to the longitudinal axis;

at least one first pattern integrally defined on one of the plurality of peripheral surfaces from a same material as the body, with the at least one first pattern having a first height relative to the one of the plurality of peripheral surfaces; and at least one second pattern defined on the one of the plurality of peripheral surfaces from the same material as the body, with the at least one second pattern having a second height; with the second height different from the first height, wherein the one of the plurality of arcuate peripheral surfaces includes the at least one first pattern parallel to the arcuate shape in the direction parallel to the longitudinal axis, with the at least one first pattern partially contacting with the object when the ball end hex wrench is driving the object and is disposed at one of various working-angle positions; and a neck including a first distal end connected with the ball end and a second distal end connected with the operating end respectively and extending arcuately from the first distal end to the second distal end.

2. The ball end hex wrench as claimed in claim 1, wherein the one of the plurality of peripheral surfaces includes the at least one first pattern extended therein and the second pattern being flush therewith, with the first pattern defining a continuous recess, and wherein the at least one first pattern includes a longitudinal length extending in the direction parallel to the longitudinal axis, with all the longitudinal length of the at least one first pattern capable of contacting with the object.

3. The ball end hex wrench as claimed in claim 2, wherein the at least one first pattern includes two slopes extending continuously in the arcuate shape in the direction parallel to the longitudinal axis, with the two slopes disposed oppositely, with the two slopes extending towards each other, with the two slopes including a continuous, common edge defining a bottom edge of the at least one first pattern extending parallel to the arcuate shape in the direction parallel to the longitudinal axis.

4. The ball end hex wrench as claimed in claim 2, wherein the at least one first and second patterns include a plurality of first and second patterns, with the plurality of first and second patterns extending parallel to the arcuate shape in the direction parallel to the longitudinal axis, with two of the plurality of first patterns including one of the plurality of second patterns disposed therebetween.

5. The ball end hex wrench as claimed in claim 2, wherein the at least one first and second patterns include a plurality of first and second patterns formed on each of the plurality of peripheral surfaces, with the plurality of first and second patterns extending parallel to the arcuate shape in the direction parallel to the longitudinal axis, with two of the plurality of first patterns including one of the plurality of second patterns disposed therebetween.

6. The ball end hex wrench as claimed in claim 1, wherein the one of the plurality of peripheral surfaces includes the at least one first pattern extended outward therefrom, with the least one second pattern being flush with the one of the plurality of peripheral surfaces, with each of the plurality of first patterns defining a continuous ridge extending parallel to the arcuate shape in the direction parallel to the longitudinal axis.

7. The ball end hex wrench as claimed in claim 6, wherein the at least one first and second patterns comprises a plurality of first patterns extended outward from the at least one of the plurality of peripheral surfaces and a plurality of second patterns flush with the at least one of the plurality of peripheral surfaces, with each of the plurality of first patterns defining a continuous ridge extending parallel to the arcuate shape in the direction parallel to the longitudinal axis.

8. The ball end hex wrench as claimed in claim 6, wherein the at least one first pattern includes a longitudinal length parallel to the longitudinal axis, with all the longitudinal length of the at least one first pattern capable of contacting with the object.

9. The ball end hex wrench as claimed in claim 7, wherein each of the plurality of first patterns includes a longitudinal length parallel to the longitudinal axis, with all the longitudinal length of each of theplurality of first patterns capable of contacting with the object.

* * * * *